US009350067B2

(12) United States Patent
Son

(10) Patent No.: US 9,350,067 B2
(45) Date of Patent: May 24, 2016

(54) ANTENNA FOR SATELLITE COMMUNICATION

(75) Inventor: Min-Son Son, Hwaseong-si (KR)

(73) Assignee: INTELLIAN TECHNOLOGIES INC. (KR)

( * ) Notice: Subject to any disclaimer, the term of this patent is extended or adjusted under 35 U.S.C. 154(b) by 208 days.

(21) Appl. No.: 14/004,238

(22) PCT Filed: Mar. 5, 2012

(86) PCT No.: PCT/KR2012/001608

§ 371 (c)(1),
(2), (4) Date: Sep. 10, 2013

(87) PCT Pub. No.: WO2012/124916

PCT Pub. Date: Sep. 20, 2012

(65) Prior Publication Data

US 2013/0341483 A1 Dec. 26, 2013

(30) Foreign Application Priority Data

Mar. 15, 2011 (KR) ..... 10-2011-0022697

(51) Int. Cl.
*H01Q 1/20* (2006.01)
*H01Q 3/02* (2006.01)
*H01Q 19/12* (2006.01)

(52) U.S. Cl.
CPC . *H01Q 1/20* (2013.01); *H01Q 3/02* (2013.01); *H01Q 19/12* (2013.01)

(58) Field of Classification Search
CPC ..... H01Q 3/02; H01Q 19/12; H01Q 1/20
USPC ..... 248/580; 343/DIG. 1, 765, 766, 709; 74/572.2, 20, 574.2
See application file for complete search history.

(56) References Cited

U.S. PATENT DOCUMENTS

| | | | | |
|---|---|---|---|---|
| 5,419,521 | A * | 5/1995 | Matthews | 248/278.1 |
| 6,020,867 | A * | 2/2000 | Shimada et al. | 345/87 |
| 7,663,565 | B2 | 2/2010 | Son et al. | |
| 8,746,663 | B2 * | 6/2014 | Mitsch | 267/294 |
| 2007/0251278 | A1 * | 11/2007 | Barcha et al. | 68/23.3 |
| 2008/0258988 | A1 * | 10/2008 | Son et al. | 343/765 |

FOREIGN PATENT DOCUMENTS

| | | |
|---|---|---|
| JP | 06196918 | 7/1994 |
| KR | 1020050037011 | 4/2005 |
| KR | 1020070043165 | 4/2007 |

OTHER PUBLICATIONS

International Search Report—PCT/KR2012/001608 dated Oct. 10, 2012.

* cited by examiner

*Primary Examiner* — Dameon E Levi
*Assistant Examiner* — Ab Salam Alkassim, Jr.
(74) *Attorney, Agent, or Firm* — Cantor Colburn LLP

(57) ABSTRACT

Provided is a satellite communication antenna, including a signal transmitting/receiving section for receiving signals from a satellite and transmitting the signals to the satellite; a driving section for rotating the signal transmitting/receiving section so that the signal transmitting/receiving section tracks the satellite; a main post, provided in a longitudinal direction, for supporting the driving section; and a vibration absorption section, provided to a circumference of the main post, for preventing vibrations or impacts from transferring into the signal transmitting/receiving section, thereby to attenuate vibrations or impacts acting on the signal transmitting/receiving section in up and down direction.

10 Claims, 10 Drawing Sheets

ANTENNA FOR SATELLITE COMMUNICATION

BACKGROUND OF THE INVENTION

1. Field of the Invention

The present invention relates to a satellite communication antenna, and more particularly to the satellite communication antenna providing a plurality of dampers outside a main post to improve the convenience of maintenance for an azimuth belt.

2. Description of the Related Art

A satellite antenna is generally used for satellite communication, high-capacity wireless communication, etc. The satellite antenna concentrates signals received using the principal of a reflecting telescope on at least one focus. Generally, the focus position of the satellite antenna may be disposed with a horn antenna or a feed horn. Wherein, the antenna representing the satellite antenna is a parabolic antenna.

The satellite antenna generally has a pedestal structure capable of performing rotation movement based on 3 axes because the horn antenna or feed horn should be always disposed toward the satellite at constant position. In order to perform the rotation movement based on 3 axes, a power transfer section using many belts and pulleys is used at the satellite antenna.

The satellite antenna is used with the damper to support the weight of a main reflecting plate having a parabolic shape, including the power transfer section of the satellite antenna, or to prevent vibrations or impacts caused due to surrounding environment.

The damper used at a prior satellite antenna supports the main reflecting plate and one damper is used inside a hollow pillar member formed up and down. That is, an internal damper formed inside a pillar member is used.

However, the cable for supplying various electric power and the cable for transferring signals are passed to the space in the pillar member wherein the cables are disposed together with the damper in a limited interior space of the pillar member and therefore the maintenance of the cables and damper are inconvenient.

In addition, in order to replace or repair the azimuth belt wound on an azimuth pulley for controlling azimuth angles of the main reflecting plate, replacing operation for the belt is possible only after disassembling or detaching the main reflecting plate or different parts. This is because there is no the gap or space that may pick or put the belt, from the pillar member to the main reflecting plate.

Further, in case of a prior satellite antenna, the actuation of the antenna should be stopped and the pillar member of the antenna should be disassembled to replace or repair the damper.

Further, in case of a prior satellite antenna, the vibrations or impacts on the antenna are attenuated by using one damper in the pillar member, wherein the absorption capacity of the vibrations or impacts is not large by using one damper only, thereby not to perform adequate attenuation. Particularly, in case of the satellite antenna used in the limited space and having large weight, the lowering for the absorption capacity of the vibrations or impacts may badly affect on life or performance of the antenna.

SUMMARY OF THE INVENTION

One embodiment of the present invention provides a satellite communication antenna using a main post for supporting a signal transmitting/receiving section including a main reflecting plate and a damper spatially detached from the main post.

Another embodiment of the present invention provides the satellite communication antenna capable of easily replacing the azimuth belt or maintaining the belt without disassembling or detaching the antenna.

Further another embodiment of the present invention provides the satellite communication antenna that may adequately use the space in the main post and may facilitate the maintenance of various cables.

Still further another embodiment of the present invention provides the satellite communication antenna that may attenuate the vibrations or impacts having up and down direction and different direction.

A satellite communication antenna in one embodiment of the present invention for solving the above problems may include a signal transmitting/receiving section for receiving signals from a satellite or transmitting the signals to the satellite; a driving section for rotating the signal transmitting/receiving section so that the signal transmitting/receiving section tracks the satellite; a main post, provided in a longitudinal direction, for supporting the driving section; and a vibration absorption section, provided to a circumference of the main post, for preventing vibrations or impacts from transferring into the signal transmitting/receiving section.

As above, the vibration absorption section is separated from the main post, thereby to enhance availability for an interior space of the main post in which various cables are passed and to enhance the convenience of maintenance for the vibration absorption section.

The vibration absorption section may include a plurality of dampers disposed at the same intervals on the same radius according to the center of the main post.

The vibration absorption section may include a plurality of mounts radially provided between the dampers according to the center of the main post.

The vibration absorption section is formed below an azimuth pulley for rotating the signal transmitting/receiving section according to the center of the main post.

The dampers may include a damper shaft provided in parallel with the main post, and a plurality of damper springs provided to the outside thereof along the longitudinal direction of the damper shaft.

The plurality of damper springs is disposed up and down along the longitudinal direction of the damper shaft, and the damper shaft may be formed with a compartment section for detaching the damper spring.

The plurality of damper springs have at least one of winding length, cross-sectional shape, size of diameter or elastic modulus different from each other.

The damper further includes an elastic member provided between windings of the damper spring.

The elastic member has the same winding type as the damper spring, and prevents the windings of the damper spring from contacting.

The elastic member may be formed using at least one of rubber, silicon or urethane.

A bottom of the azimuth pulley is disposed with a pulley plate for supporting the azimuth pulley, and the bottom of the pulley plate is disposed with a damper plate to be spaced apart from the pulley plate.

A gap spaced between the pulley plate and damper plate is maintained by the damper shaft An azimuth belt wound on the azimuth pulley is removable using the gap formed between the pulley plate and damper plate.

A top flange formed at the top of the main post is disposed at the bottom of the damper plate in the state to be spaced apart from the damper plate, and the plurality of mounts is provided between the damper plate and the top flange.

The mount alleviates the vibrations or impacts on the signal transmitting/receiving section in the up and down direction, in the transverse direction or in the forward and backward direction.

DETAILED DESCRIPTION OF THE PREFERRED EMBODIMENT

Figure 1:
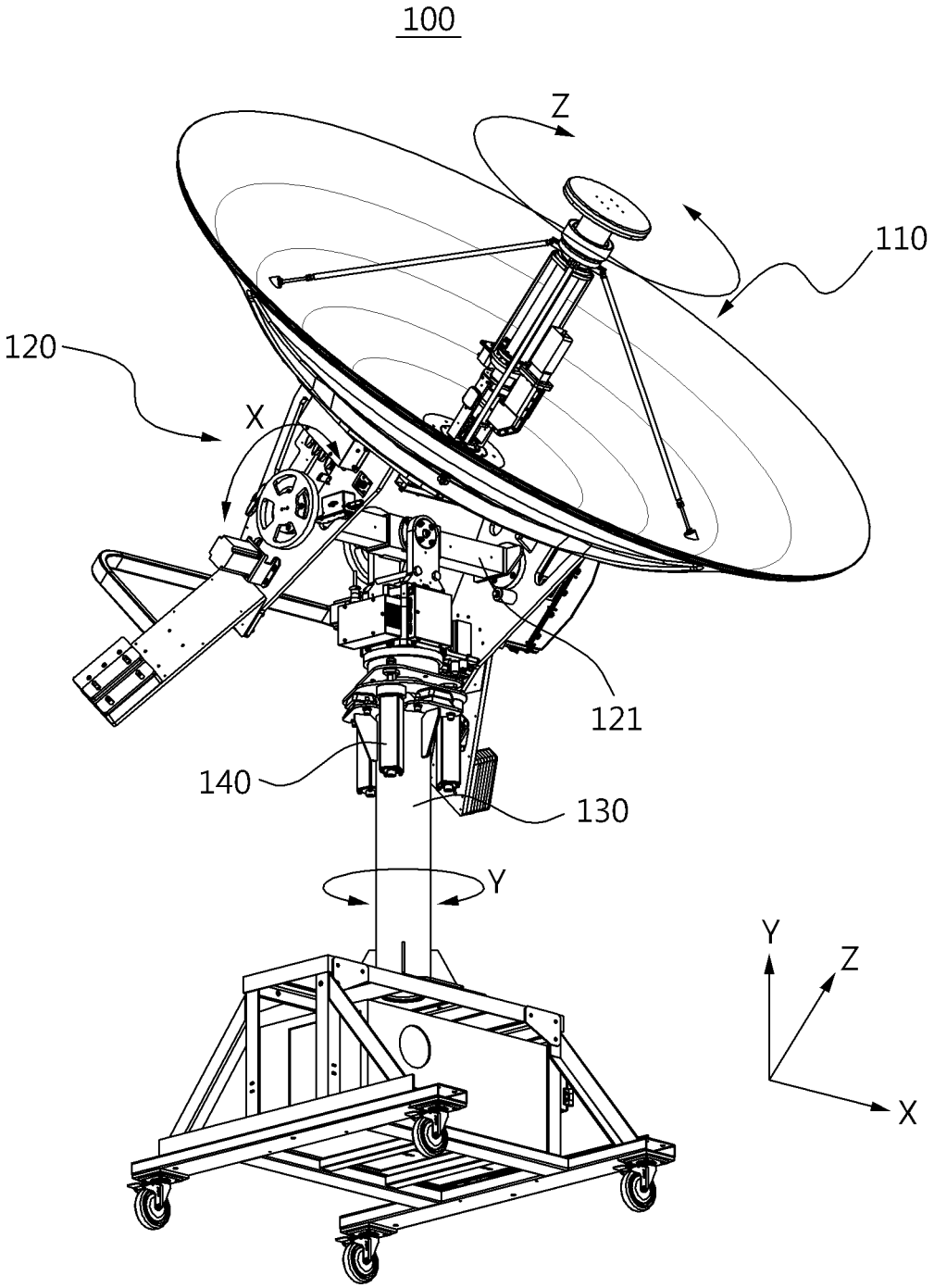
FIG. 1 is a perspective view showing a satellite communication antenna according to one embodiment of the present invention.

Hereinafter, embodiments of the present invention will be described in detail with reference to the accompanying drawings. Therefore, the present invention is not limited to the embodiments. Like reference numerals refer to like elements.

Figure 2:
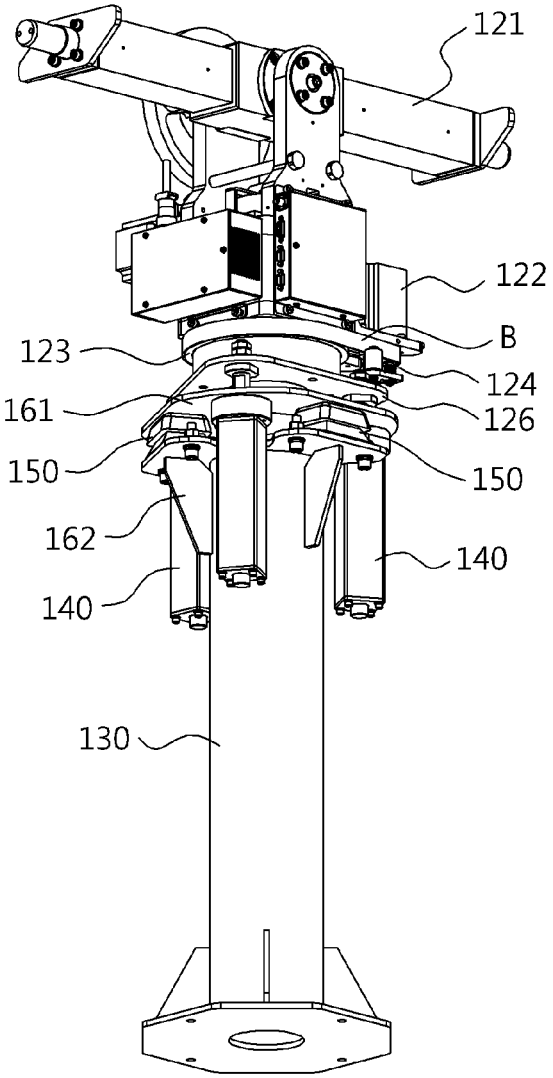
FIG. 2 is a perspective view showing the center including a vibration absorption section of the satellite communication antenna shown in FIG. 1.
Figure 3:
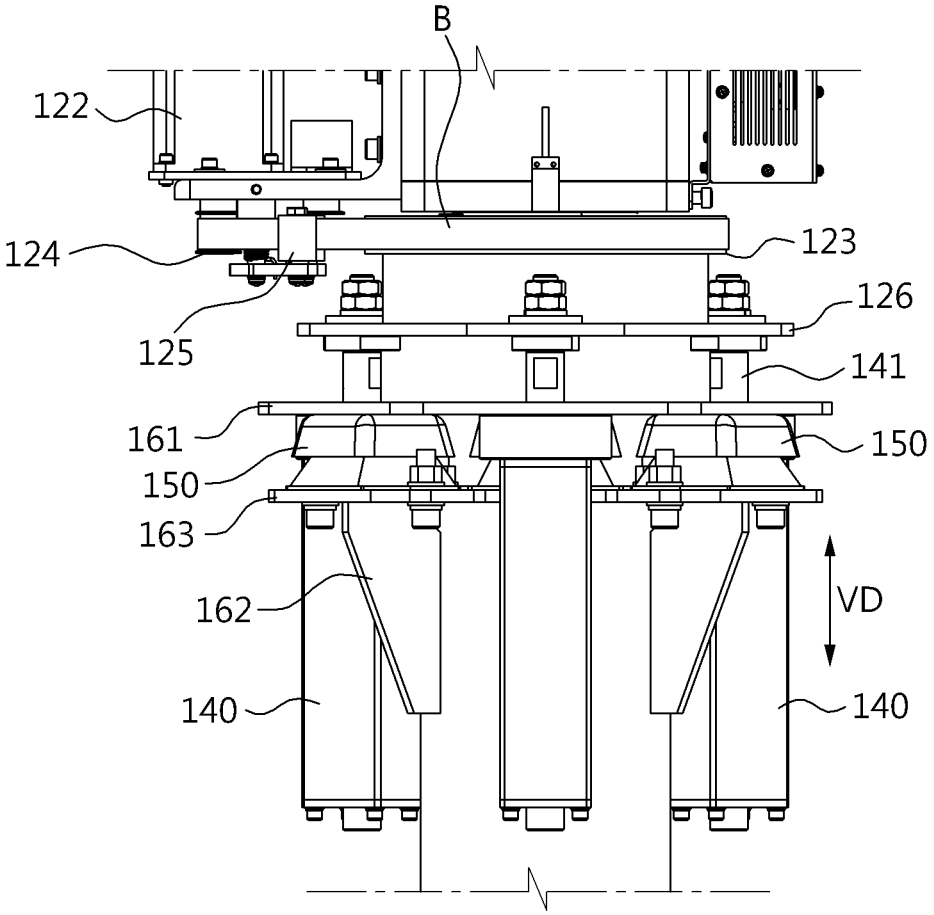
FIG. 3 is a front view showing the vibration absorption section shown in FIG. 2.
Figure 4:
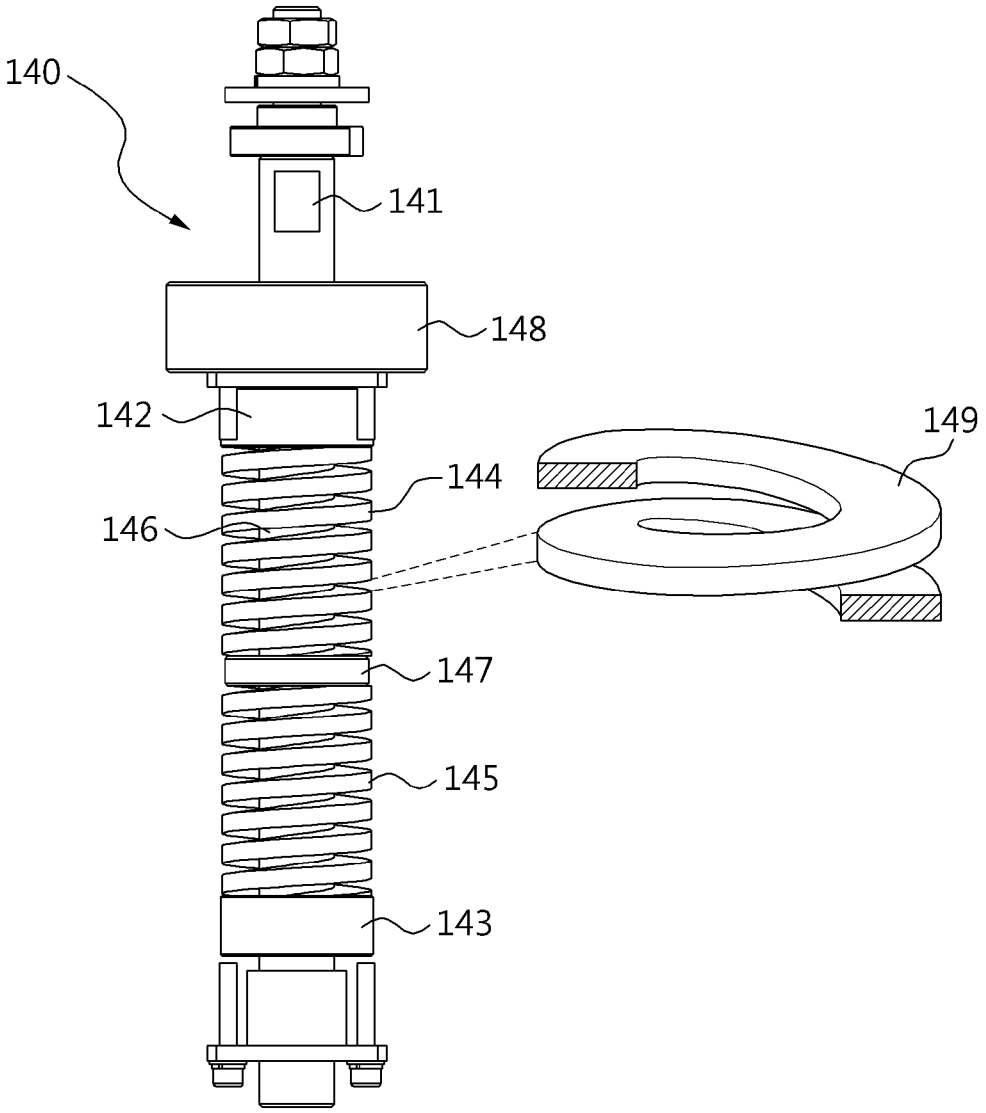
FIG. 4 is a front view showing the inside of the vibration absorption section shown in FIG. 3
Figure 5:
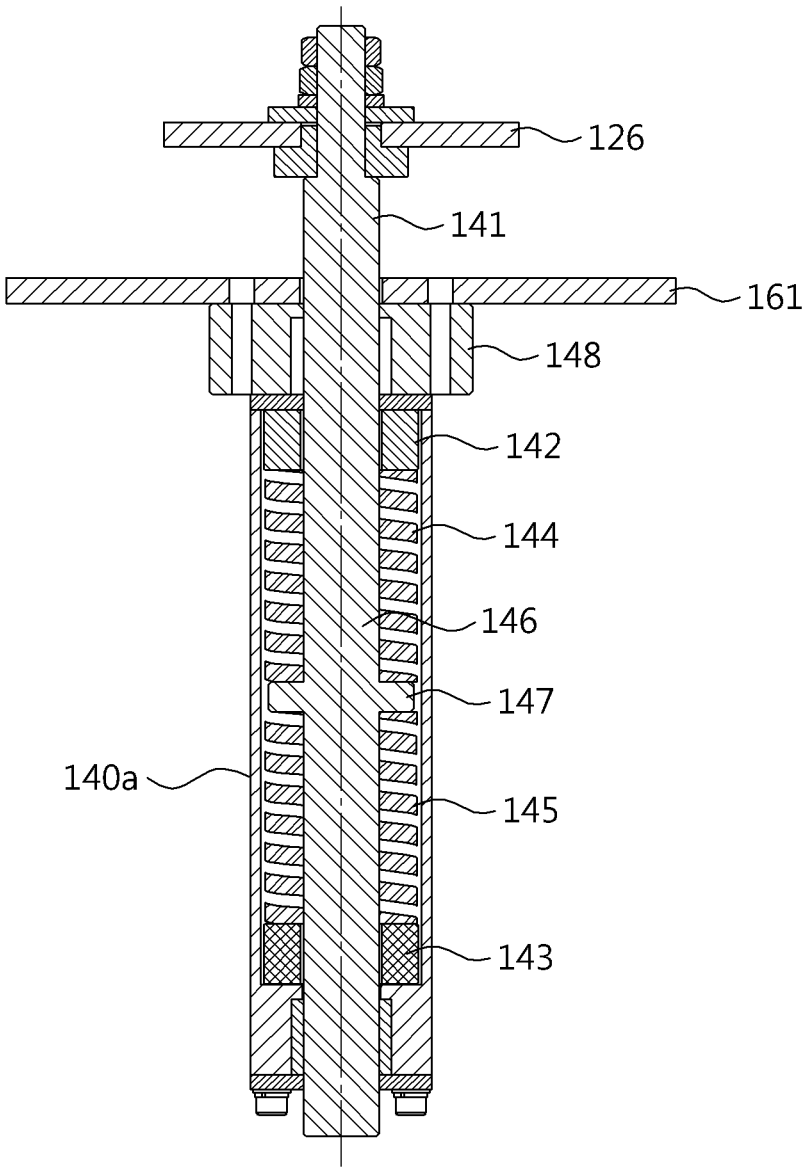
FIG. 5 is a cross-sectional view showing the inside of a damper shown in FIG. 3.
Figure 6A:
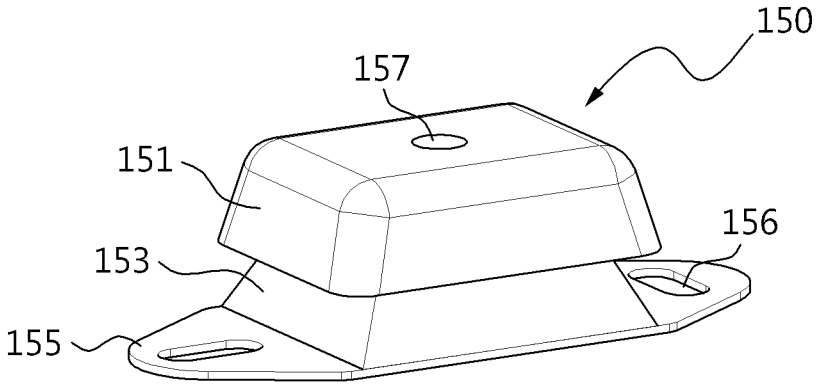
FIGS. 6A and 6B are a perspective view and cross-sectional view showing a mount of the vibration absorption section shown in FIG. 3.
Figure 6B:
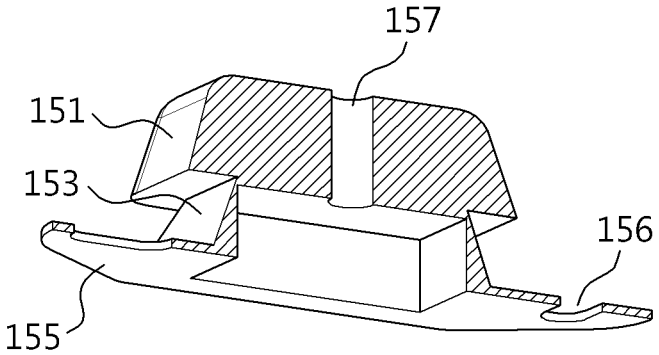

FIG. 1 is a perspective view showing a satellite communication antenna according to one embodiment of the present invention, FIG. 2 is a perspective view showing the center including a vibration absorption section of the satellite communication antenna shown in FIG. 1, FIG. 3 is a front view showing the vibration absorption section shown in FIG. 2, FIG. 4 is a front view showing the inside of the vibration absorption section shown in FIG. 3, FIG. 5 is a cross-sectional view showing the inside of a damper shown in FIG. 3, FIGS. 6A and 6B are a perspective view and cross-sectional view showing a mount of the vibration absorption section shown in FIG. 3, and FIGS. 7A and 7B and FIGS. 8A and 8B are a front view and perspective view showing a process for replacing an azimuth belt in the state including the vibration absorption section shown in FIG. 3.

Referring FIG. 1 and FIG. 2, a satellite communication antenna 100 in one embodiment of the present invention may include a signal transmitting/receiving section 110 for receiving signals from a satellite or transmitting the signals to the satellite, a driving section 120 for rotating the signal transmitting/receiving section 110 so that the signal transmitting/receiving section 110 tracks the satellite, a main post 130, provided in up and down direction, for supporting the driving section 120, and a vibration absorption section, provided to a circumference of the main post 130, for preventing transfer of vibrations or impacts into the signal transmitting/receiving section 110.

As above, the vibration absorption section is detached from the main post 130, thereby to enhance availability for an interior space of the main post 130 in which various cables are passed and to enhance the convenience of maintenance for the vibration absorption section.

The satellite communication antenna 100 in one embodiment of the present invention, which is the satellite communication antenna for transmitting/receiving multiple polarized waves, is capable of performing bidirectional communication, etc., including Internet communication etc., receiving signals from the satellite or transmitting the signals to the satellite, and is called a VSAT (Very Small Aperture Terminal) antenna.

The signal transmitting/receiving section 110 may include a reflecting plate for collecting the signals to receive the signals from the satellite, and a horn antenna (or feed horn) for receiving the signals reflected from the reflecting plate, etc. But, the VSAT antenna is an example for the satellite communication antenna in one embodiment of the present invention, and the antenna described in the present invention is not limited to it having such a type or size.

On the other hand, the satellite communication antenna 100 in one embodiment of the present invention, which is mounted in a ship, etc., always tracks the satellite even in traveling ship or at turbulent waves and therefore has to be directed to the satellite. Therefore, the reflecting plate should include the driving section 120 that may rotate for three axes (X, Y, Z axis) to direct the satellite wanting to receive the signals.

As shown in FIG. 1, the signal transmitting/receiving section 110 must be able to rotate on a Z axis (a direction disposed with the horn antenna), a X axis (a direction disposed with a horizontal post 121) or a Y axis (a direction disposed with the main post) by the driving section 120. The driving section 120 includes various kinds of motors, supporting frames, pulleys and belts, etc. and therefore the weight of the signal transmitting/receiving section 110 and the driving section 120 occupies most of the weight of the satellite communication antenna. Therefore, vibrations or impacts are always transferred to the signal transmitting/receiving section 110 by traveling ship or waves wherein, if such vibrations or impacts are not attenuated, the driving section 120 or the signal transmitting/receiving section 110 may be destroyed or the signal transmitting/receiving sensitivity may be lowered due to the increase in fatigue loading, etc.

Likewise, it is desirable to dispose the vibration absorption section, in the circumference of the main post 130, for attenuating the vibrations or impacts for the signal transmitting/receiving section 110 or the driving section 120. That is, the vibration absorption section may be disposed at the outside of the main post 130.

The main post 130, which is a pillar for fixing the satellite communication antenna 100 to a ship, etc., supports most of the weight of the satellite communication antenna 100, including the signal transmitting/receiving section 110 or the driving section 120, and it is necessary that the inside of the main post 130 has a hollow type to secure adequate space. Various kinds of cables, that supplies power or transmits the signals to various electric/electronic parts included in the signal transmitting/receiving section 110 and the driving section 120, may be passed to the interior space of the main post 130.

In case of the satellite communication antenna 100 in one embodiment of the present invention, springs, etc. for attenuating the vibrations or impacts are not disposed inside the main post 130, and therefore maintenance such as replacing or repairing for various cables may be conveniently performed using adequate or enough space secured inside the main post 130.

Referring to FIG. 2, the vibration absorption section may include a plurality of dampers 140 disposed at the same intervals on the same radius according to the center of the main post 130. The plurality of dampers 140 configuring the vibration absorption section are radially provided according to the center of the main post 130 and may be disposed at the same intervals on the same radius from the center of the main post 130. That is, the dampers 140 in one embodiment of the present invention are external dampers disposed outside the main post 130, not internal dampers disposed inside the main post 130.

The vibration absorption section including the plurality of dampers 140 in the outer circumference of the main post 130 or outside it may effectively attenuate the vibrations or impacts caused in the up and down direction by the weight of the signal transmitting/receiving section 110 and the vibrations or impacts caused by eccentric load caused according to the center of the main post 130.

Further, the vibration absorption section may include a plurality of mounts 150 radially provided between the dampers 140 according to the center of the main post 130. The plurality of mounts 150 may be disposed between the dampers 140 on the same intervals from the center of the main post 130.

The dampers 140 mainly attenuates the vibrations or impacts, having the up and down direction, that is, the direction of the Y axis (refer to arrow VD in FIG. 3), on the signal transmitting/receiving section 110, while the mounts 150 may alleviate the vibrations or impacts, having the up and down direction, in the transverse direction or in the forward and backward direction, on the signal transmitting/receiving section 110. That is, the mounts 150 may prevent that the vibrations or impacts caused in the directions of the X axis, Y axis and Z axis are transferred into the signal transmitting/receiving section 110 and the driving section 120. Further, the mounts 150 may also attenuate torsional moment, etc. caused on the Y axis or the main post 130. The plurality of external dampers 140 disposed in the vertical direction has large absorption capacity for the vibrations or impacts having the direction of the Y axis, while the mounts 150 have absorption capacity smaller than the dampers 140.

On the other hand, as shown in FIG. 3, the vibration absorption section including the dampers 140 and the mounts 150 may be formed below an azimuth pulley 123 rotating the signal transmitting/receiving section 110 according to the center of the main post 130.

The azimuth pulley 123, which configures the driving section 120, rotates the signal transmitting/receiving section 110 on Z axis or the main post 130 to control azimuth angles. One side of the azimuth pulley 123 is disposed with an azimuth motor 122, and a driving pulley 124 and the azimuth pulley 123 provided to the azimuth motor 122 are wound with an azimuth belt B. One side of the driving pulley 124 may be provided with a tension roller 125 for maintaining tension of the azimuth belt B. The tension roller 125 presses the azimuth belt B inwardly from the outside to maintain the tension of the belt.

On the other hand, an azimuth pulley 123 may be supported by a pulley plate 126 provided at the bottom thereof. That is, a bottom surface of the azimuth pulley 123 may be supported to be contacted with the azimuth pulley 123. It is desirable that the center of the pulley plate 126 is formed with a hole (not shown) for communicating with the interior space of the main post 130.

Further, a damper plate 161 disposed to be spaced apart from the pulley plate 126 may be provided below the pulley plate 126. It is desirable that the center of the damper plate 161 is also formed with a hole (not shown) for communicating with the interior space of the main post 130.

Referring to FIG. 3, the damper plate 161 may be provided below the pulley plate 126 at constant intervals. A constant gap or space for using on replacing the azimuth belt B is formed between the pulley plate 126 and the damper plate 161. The azimuth belt B may be replaced using a gap or space formed between the pulley plate 126 and the damper plate 161 and therefore, it is unnecessary to detach the signal transmitting/receiving section 110 and driving section 120 from the main post 130 on replacing the azimuth belt B. Amore detailed description about the above contents is described hereinafter.

A damper shaft 141 may maintain the gap or space between the pulley plate 126 and the damper plate 161. One of parts of the dampers 140, that is, the damper shaft 141, in which a top thereof is fastened to the pulley plate 126 by a bolt, etc., may maintain a constant gap between the pulley plate 126 and the damper plate 161.

The dampers 140 may be provided below the damper plate 161, and a top flange 163 formed at the top of the main post 130 may be provided below the damper plate 161. The damper plate 161 is also spaced apart from the top flange 163, and the mounts 150 may be provided at the space between them. That is, the mounts 150 may be provided between the damper plate 161 and the top flange 163. The top flange 163 mounted with the mounts 150 is a mount plate for supporting the mount 150.

As shown in FIG. 2 and FIG. 3, the top flange 163 mounted with the mounts 150 is disposed outside an outer surface of the main post 130 and therefore, the top flange 163 is destroyed or is bent downwardly due to the weight on the mounts 150. In order to prevent this, a supporting rib 162 for supporting the top flange 163 may be formed through a bottom surface of the top flange 163 and an outer surface of the main post 130.

On the other hand, the dampers 140 are disposed between the mounts 150, and it is desirable that the top flange 163 is formed with a flection (not shown) for the damper 140 to avoid interference between the top flange 163 and the dampers 140. The antenna 100 having 3 dampers is shown in the drawings, but it is only illustrative and the number of the dampers may be varied according to design conditions.

The dampers 140 may elastically support the pulley plate 126 and the damper plate 161. The dampers 140 may attenuate the vibrations or impacts caused by the weight present above the pulley plate 126. On the other hand, the mounts 150 may attenuate the vibrations or impacts caused by the weight present above the damper plate 161.

Further, the pulley plate 126 is fastened to a damper shaft 141 and therefore may perform a vertical movement only to the damper shaft 141. Therefore, the dampers 140 may attenuate the vibrations or impacts mostly caused in the direction of Z axis. On the other hand, the damper plate 161 is laid on the mounts 150 including a cushioning section made with rubber or silicon, and therefore, the mounts 150 may attenuate the vibrations or impacts caused in all directions including the up and down direction, the forward and backward direction and the transverse direction.

Hereinafter, a detailed structure of the dampers 140 is described with reference to the drawings. Referring to FIG. 4 and FIG. 5, the dampers 140 may include a damper case **140*a* formed with a predetermined space inside it, a shaft body 146 inserted into the damper case 140*a* and provided in parallel with the main post 130, and a plurality of damper springs 144 and 145 provided to the shaft body 146 and the damper case 140***a*.

A damper supporting section 148 formed at the top of the shaft body 146, which supports to be contacted with the bottom of the damper plate 161, has the weight on the damper springs 114 and 145.

On the other hand, a plurality of damper springs 144 and 145 disposed between the shaft body 146 and damper case 140*a* are provided to the outer surface thereof along the longitudinal direction of the damper shaft 141 or the shaft body 146, and it is desirable to detachedly dispose the damper springs 144 and 145 in the up and down direction. To this end, the center of the damper shaft 141 or the shaft body 146 may be formed with a compartment section 147 for detaching or separating the damper springs 144 and 145. Further, the inside of the damper case 140*a* may be formed with a top supporting section 142 for supporting the top of a first damper spring 144 disposed at the top thereof and a bottom supporting section 143 for supporting the bottom of a second damper spring 145 disposed at the bottom thereof. The top of the first damper spring 144 and the bottom of the second damper spring 145 may be supported to be directly contacted with the damper case 140*a* without the top supporting section 142 and bottom supporting section 143.

The damper 140 having 2 damper springs 144 and 145 is shown in FIG. 4 and FIG. 5, but the number of the damper spring may be determined according to the size of the vibrations or impacts wanting to attenuate.

It is possible to form the first damper spring 144 and the second damper spring 145 having the same shape and the same elasticity coefficient, but it is also possible to differ at least one of winding length, cross-sectional shape, the size of a diameter or elasticity coefficient from each other. Wherein, the winding length is the length unfolded so that the wound damper spring becomes a line type, and the shape of the cross-section thereof is the shape of the cross-section for a wire unfolded as the line type.

For example, the first damper spring 144 disposed at the top thereof uses a soft spring having small elasticity coefficient and the second damper spring 145 disposed at the bottom thereof uses a hard spring having large elasticity coefficient such that the vibrations caused by waves, etc. may be attenuated by both of the damper springs 144 and 145 in the state that the first damper spring 144 supports the weight of the signal transmitting/receiving section 110 and the driving section 120. Further, the first damper spring 144 using long spring has the elasticity coefficient smaller than the damper springs 144 and 145 in consideration of initial compression for the damper spring caused by the weight of the signal transmitting/receiving section 110 and the driving section 120.

The damper 140 of the satellite communication antenna 100 in one embodiment of the present invention may further include an elastic member 149 provide d to windings of the damper springs 144 and 145. As shown in FIG. 4, the elastic member 149 has the same winding type as the damper springs 144 and 145 and may prevent windings of the damper springs 144 and 145 from contacting. When there is no the elastic member 149, the damper springs 144 and 145 are completely compressed on applying excessive weight to the damper springs 144 and 145 and therefore, the weight may be continually applied in the contacting state between the windings of the damper spring. Thus, the damper spring may not absorb the vibrations or impacts, thereby to destroy an antenna, etc. In order to prevent this phenomenon, it is desirable to separately insert the elastic member 149 between the windings of the damper springs 144 and 145.

The elastic member 149 may be made by at least one of rubber, silicon or urethane, and it is desirable to use low repulsion or low elasticity urethane when using the urethane.

On the other hand, the mount 150 in FIGS. 6A and 6B may include a cap 151 for supporting the damper plate 161, a cushioning section 153 formed at the bottom of the cap 151, and a mounting plate 155 formed at the bottom of the cushioning section 153, below the damper plate 161. The cap 151 is made by metal material and the cushioning section 153 may be made by the rubber or silicon material. The cushioning section 153 may be coupled with the cap 151 by using the fastening member such as the bolt, etc. or adhesive, and the cap 151 may be formed with a through hole 157 for coupling them. The mounting plate 155 may be formed with a fastening hole 156 for fastening the mount 150 to the top flange 163. The cushioning section 153 may attenuate the vibrations or impacts, in the up and down direction, in the transverse direction or in the front and backward direction, on the cap 151.

As described above, the azimuth belt B wound to the azimuth pulley 123 and the azimuth motor 122 is removable using the gap or space formed between the pulley plate 126 and the damper plate 161 in the satellite communication antenna 100 of one embodiment of the present invention. On replacing or removing the azimuth belt B, it is unnecessary to detach the azimuth pulley 123 from the main post 130 or to detach the signal transmitting/receiving section 110. The belt may be removed while in order disassembling the fastening between the damper 140 or damper shaft 141 and the pulley plate 126 in the state maintaining the gap or space formed between the pulley plate 126 and the damper plate 161.

Referring to FIGS. 7A to 8B, in order to remove the azimuth belt B, how to maintain the space between the pulley plate 126 and the damper plate 161 is shown.

In order to remove the azimuth belt B using the gap or space between the pulley plate 126 and the damper plate 161, the damper shaft 141 must be detached from the pulley plate 126. When the damper shaft 141 is not detached from the pulley plate 126, the azimuth belt Bis caught on the damper shaft 141, thereby not to put or pick the azimuth belt into the gap or space.

Further, when all the damper shafts 141 mounted in the pulley plate 126 are detached, the damper plate 161 and the pulley plate 126 are attached while sinking the pulley plate 126 and therefore, and the azimuth belt may not be removed. Therefore, after detaching the damper shaft 141 in order, it is necessary to insert a separable gap maintaining member into where the separated damper shaft 141 was. For example, as shown in FIGS. 7A to 8B, it is possible to use a spacer 160 having the almost same height as the interval between the pulley plate 126 and the damper plate 161.

A process for disassembling releasing and picking the azimuth belt B wound on the azimuth motor 122 and azimuth pulley 123 is described.

Figure 7A:
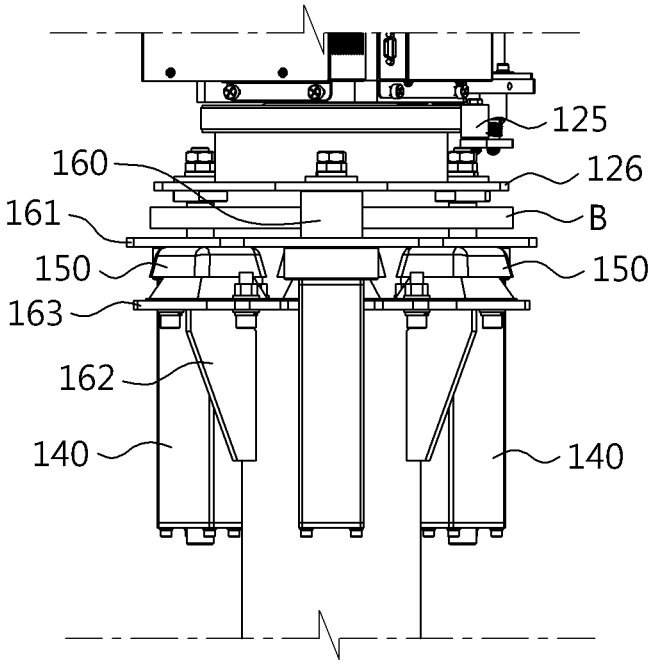
FIGS. 7A and 7B and FIGS. 8A and 8B are a front view and perspective view showing a process for replacing an azimuth belt in the state including the vibration absorption section shown in FIG. 3.
Figure 7B:
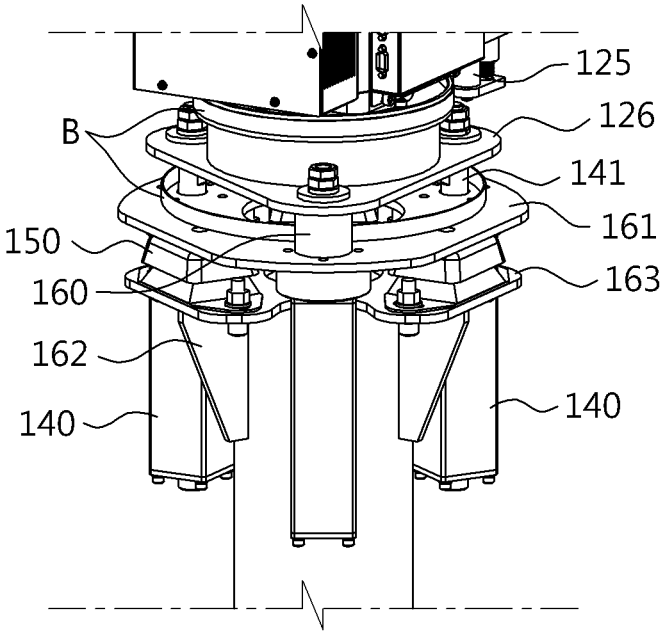

Referring to FIGS. 7A and 7B, the azimuth belt B is detached from the azimuth motor 122 and azimuth pulley 123, the azimuth belt B remains at the circumference of the damper 140, the damper shaft at the center is disassembled, and a part of the belt B is pushed through the gap (that is, the gap between the pulley plate and damper plate) at which the damper shaft was.

Next, the spacer 160 is inserted into the position adjacent to the detached damper shaft and therefore, the damper shaft prevents the pulley plate 126 from sinking in the detached part. By doing this, the belt B is disposed along the exterior of the damper shaft 141 and the interior of the spacer 160 shown on the left and right in FIGS. 7A and 7B. That is, first, the azimuth belt B is disposed toward the driven pulley 164 and the tension pulley 125 (refer to the belt shown at the top of FIG. 7B), but on performing the process, the azimuth belt B is disposed between the pulley plate 126 and damper plate 161. Next, the damper shaft is fastened to its original position and the spacer 160 is picked.

Figure 8A:
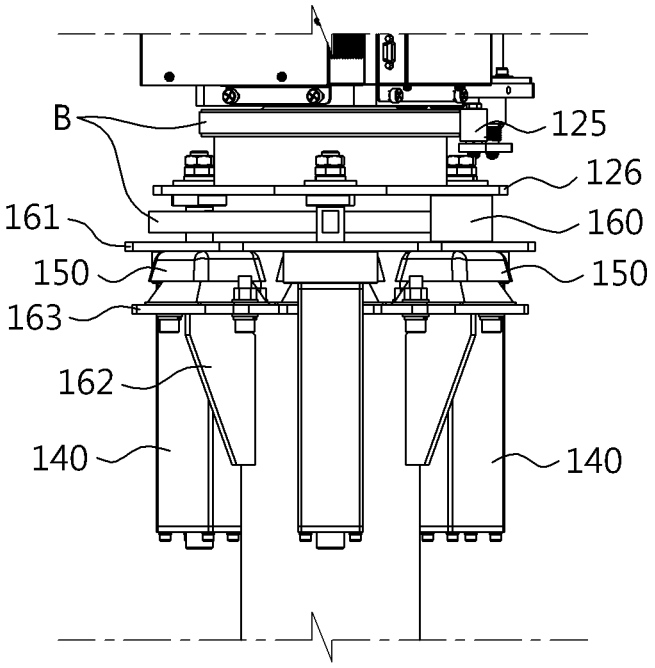
Figure 8B:
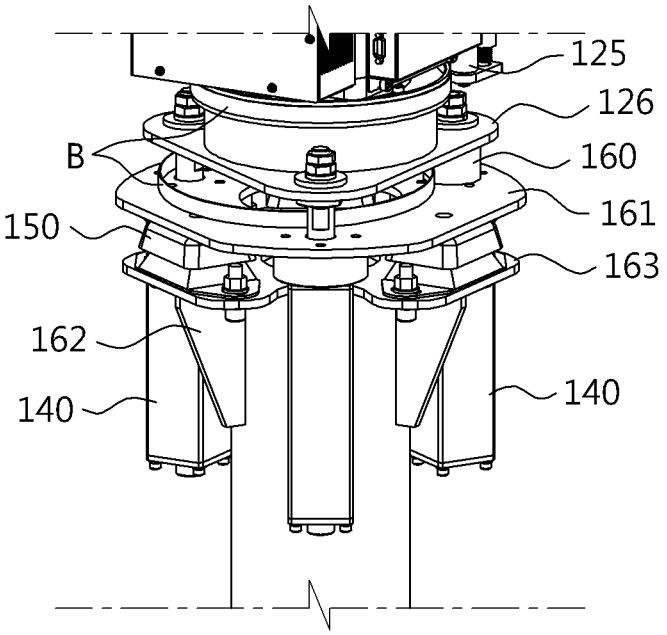

In addition, the process shown in FIGS. 7A and 7B is repeated for the damper shaft shown on the right of FIGS. 8A and 8B. The belt B is disposed along the exterior of the damper shaft shown on the left and the interior of the damper shaft and spacer 160 shown at the center, in FIGS. 8A and 8B. Finally, although not shown, the same process is repeated for the damper shaft shown on the left of FIGS. 8A and 8B. When the above process is repeated for all damper shafts 141, the azimuth belt B not caught on the damper shaft 141 is disposed at the interior of the damper shaft 141, and the azimuth belt B may be picked between the damper shafts 141.

On the other hand, the process for fastening new azimuth belt B to the azimuth motor 122 and azimuth pulley 123 may be implemented by performing the above process on the contrary.

The satellite communication antenna 100 in one embodiment of the present invention described so far may easily perform maintenance for various kinds of cables disposed at the interior space of the main post 130, may attenuate the vibrations or impacts, having the up and down direction, on the signal transmitting/receiving section, and may replace or remove the azimuth belt without detaching various kinds of parts. Further, because the damper is provided outside the main post in an external type, the actuation of the antenna is not stopped and it is unnecessary to disassemble the antenna even on repairing or replacing the damper.

Further, the satellite communication antenna in one embodiment of the present invention disposes a plurality of external dampers for absorbing the vibrations or impacts, having the vertical direction, outside the main post, thereby to enhance the absorption capability of the vibrations or impacts having the vertical direction. In particular, the present invention has an advantage that may effectively attenuate the vibrations or impacts on applying a plurality of external dampers having large absorption capacity of the vibrations or impacts having the vertical direction to structures having large weight in limited space such as the satellite communication antenna.

As described above, the satellite communication antenna in one embodiment of the present invention uses the damper spatially detached with the main post, thereby to enhance availability for an interior space in the main post and to improve the convenience of the maintenance of various cables provided inside the main post.

The satellite communication antenna in another embodiment of the present invention may easily replace the azimuth belt or maintain the belt without disassembling or detaching the antenna.

The satellite communication antenna in further another embodiment of the present invention may attenuate the vibrations or impacts on the signal transmitting/receiving section in the up and down direction or different direction.

The satellite communication antenna in still further another embodiment of the present invention does not stop the actuating of the antenna or does not disassemble the antenna to replace the damper according to the size of the vibrations or impacts on the antenna.

The satellite communication antenna in still further another embodiment of the present invention disposes a plurality of external dampers for absorbing the vibrations or impacts having the vertical direction outside the main post, thereby to enhance the absorption capability of the vibrations or impacts for the vertical direction.

The satellite communication antenna in still further another embodiment of the present invention disposes a plurality of external dampers outside the main post, thereby to enhance the absorption capability of the vibrations or impacts in the limited space.

As described above, although the present invention is described by specific matters such as concrete components and the like, exemplary embodiments, and drawings, they are provided only for assisting in the entire understanding of the present invention. Therefore, the present invention is not limited to the exemplary embodiments. Various modifications and changes may be made by those skilled in the art to which the present invention pertains from this description. Therefore, the spirit of the present invention should not be limited to the above-described exemplary embodiments and the following claims as well as all modified equally or equivalently to the claims are intended to fall within the scopes and spirit of the invention.

The present invention may be used for maritime or air satellite antennas.

What is claimed is:

1. A satellite communication antenna, comprising:

a signal transmitting/receiving section for receiving signals from a satellite and transmitting the signals to the satellite;

a driving section for rotating the signal transmitting/receiving section so that the signal transmitting/receiving section tracks the satellite;

a vertical main post for supporting the signal transmitting/receiving section and the driving section; and a vibration absorption section disposed around a circumference of the vertical main post and for preventing vibrations or impacts from transferring into the signal transmitting/receiving section, wherein the vibration absorption section includes a plurality of dampers disposed at same intervals along the circumference of the vertical main post, and a plurality of mounts each disposed between two neighboring dampers, the plurality of the mounts being dispose at same intervals in a circumferential direction, each of the dampers includes a damper shaft disposed vertically and in parallel with the vertical main post, a plurality of damper springs provided along a longitudinal direction of the damper shaft and each surrounding the damper shaft, and an elastic member disposed between neighboring windings of the damper spring, and the elastic member has a same winding type as that of the damper spring and prevents the neighboring windings of the damper spring from directly contacting each other.

2. The satellite communication antenna according to claim 1, further comprising an azimuth pulley for rotating the signal transmitting/receiving section about the vertical main post, wherein the vibration absorption section is formed below the azimuth pulley.

3. The satellite communication antenna according to claim 1, wherein a compartment section is disposed between neighboring damper springs.

4. The satellite communication antenna according to claim 1, wherein the plurality of the damper springs have winding length, cross-sectional shape, size of diameter and elastic modulus, at least one of which is different from each other.

5. The satellite communication antenna according to claim 1, wherein the elastic member is formed using at least one of rubber, silicon and urethane.

6. The satellite communication antenna according to claim 2, wherein a bottom of the azimuth pulley is disposed with a pulley plate for supporting the azimuth pulley, and a bottom of the pulley plate is disposed with a damper plate to be spaced apart from the pulley plate.

7. The satellite communication antenna according to claim 6, wherein a gap spaced between the pulley plate and the damper plate is maintained by the damper shaft.

8. The satellite communication antenna according to claim 7, wherein an azimuth belt wound on the azimuth pulley is removable using the gap formed between the pulley plate and the damper plate.

9. The satellite communication antenna according to claim 8, wherein a top flange formed at a top of the vertical main post is disposed at a bottom of the damper plate in a state to be spaced apart from the damper plate, and the plurality of the mounts is provided between the damper plate and the top flange.

10. The satellite communication antenna according to claim 9, wherein the plurality of the mounts alleviates the vibrations or impacts on the signal transmitting/receiving section in an up and down direction, in a transverse direction or in a forward and backward direction.

* * * * *